United States Patent [19]

Wall

[11] 3,996,989

[45] Dec. 14, 1976

[54] INSULATING FRAME AND GLAZING FOR DOORS AND WINDOWS

[75] Inventor: Harlin J. Wall, State College, Pa.

[73] Assignee: Leisure Life Inc., State College, Pa.

[22] Filed: Nov. 25, 1975

[21] Appl. No.: 635,252

[52] U.S. Cl. ..... 160/369; 160/90

[51] Int. Cl.[2] ..... E06B 3/30

[58] Field of Search ..... 160/369, 368 R, 354, 160/368 S, 89, 90, 91

[56] References Cited

UNITED STATES PATENTS

| | | | |
|---|---|---|---|
| 2,565,997 | 8/1951 | Stone | 160/369 UX |
| 3,009,515 | 11/1961 | Albee, Jr. | 160/369 |
| 3,587,705 | 6/1971 | Zappone | 160/91 |
| 3,616,838 | 11/1971 | Barr | 160/90 |

*Primary Examiner*—Philip C. Kannan

[57] ABSTRACT

An insulating apparatus for fitting over the inside frames and glass of glass doors and windows, said apparatus having an expanded polystyrene frame fitted over the inside window or door frame completely covering the inside frame from the glass to the surrounding building structure, and said frame being removably held in position by fastening means which are removably attached to the inside frame. Covering means of sheet vinyl material is stretched over the polystyrene frame and removably held in position above the glass surface by being held in a channel groove in the perimeter of the polystyrene frame by an extruded plastic retaining strip fitted into the groove.

8 Claims, 10 Drawing Figures

INSULATING FRAME AND GLAZING FOR DOORS AND WINDOWS

The present invention relates to a device for sealing windows and doors from heat loss due to infiltration of cold air and conductance through the glass and frame, especially through metal frames. The invention particularly relates to a polystyrene frame removably placed around the window or door frame inside the structure which has sheet vinyl stretched across the glass area and fastened to the polystyrene frame.

BACKGROUND OF THE INVENTION

The influx of cold air into an otherwise well insulated home (around doors and windows) accounts for approximately 30% to 50% of all heat loss, and additional heat losses occur with aluminum and steel door and window frames due to conduction through the metal to the outside.

Prior devices for sealing out cold and insulating against heat loss have generally been limited to stretching vinyl plastic across the window portion and fixing it as securely as possible. More than likely, the plastic is simply stretched over the glass and held in place either by nailing strips of wood over the edges of the plastic or perhaps simply taping the edges of the vinyl to the door or window frame, or the structural material surrounding the window frame.

In some instances, grooved frames have been permanently constructed on the outside of the window frame, the plastic stretched across the window, and then held over the window by securing it into a groove in the special frame, but the pumping action of the wind on the plastic installed on the outside of windows and doors forces the film to disintegrate in a short period of time. Therefore, these prior devices are only partially effective, and when placed on the inside of the door or window, do not present a decorative addition to the interior.

Moreover, no consideration appears to have been given to specifically eliminating the heat loss which results as a consequence of the conductance of the cold through the metal frame which surrounds many of today's windows and sliding doors - in addition to the heat loss due to the exposure of the glass. Right now, there is no convenient and effective permanent or removable framework for use with these metal sliding doors and windows which will insulate both the metal frame and the glass. In addition, no device is available which is also an acceptable addition to the interior decoration.

There are presently devices for use over the outside of the metal framed patio doors which help to keep out wind-driven rain, but such devices still do not solve the problem of heat loss through both the glass and the metal framework, and these devices are not suitable for use inside the structure as opposed to outside.

BRIEF SUMMARY OF THE INVENTION

It is the objective of the present invention to provide an insulating device which is economical, easy to install and remove on the inside of the window or door frame, which provides a decorative addition to the room and which will provide efficient control of heat loss due to infiltration of cold air and a conductance of cold through and around doors and windows.

To meet this objective, the present invention is provided with an expanded polystyrene framework comprised of variously sized framing parts for sealing from the edge of the glass to the adjacent wall material by completely encasing the window or door frame. This polystyrene frame reduces and seals out infiltration of cold air and insulates the warm air inside the room from the cold door and window frames, thereby further reducing heat loss due to conductance through the window and door frames. The polystyrene framework can be applied to all types of window and door framing materials, but is especially effective with metal frames which generally encounter greater heat loss due to infiltration and conduction.

The polystyrene frames are removably secured to the window or door frame and the frames are compressed against the glass and adjacent wall material by mechanical fasteners fitted through a groove in the polystyrene frame and attached to the window or door frame by pressure sensitive adhesive. Also fitted into the groove is the edge of a vinyl sheet stretched across the glass and held away from the glass by the polystyrene frame. The vinyl is held in place by a plastic strip which snaps into place in the groove and also covers the mechanical fasteners which secure the polystyrene frame to the door or window frame.

DETAILED DESCRIPTION

Figure 1:
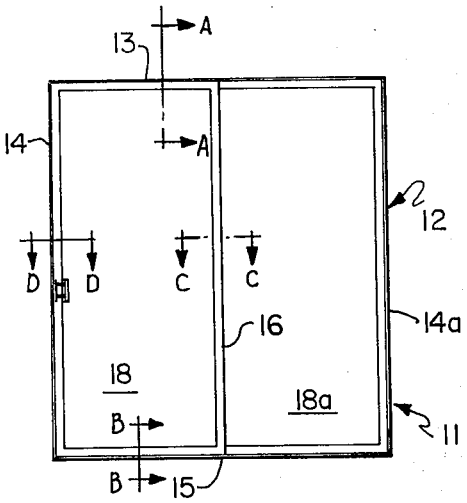
FIG. 1 is an interior front elevation of a metal sliding glass door.
Figure 2:
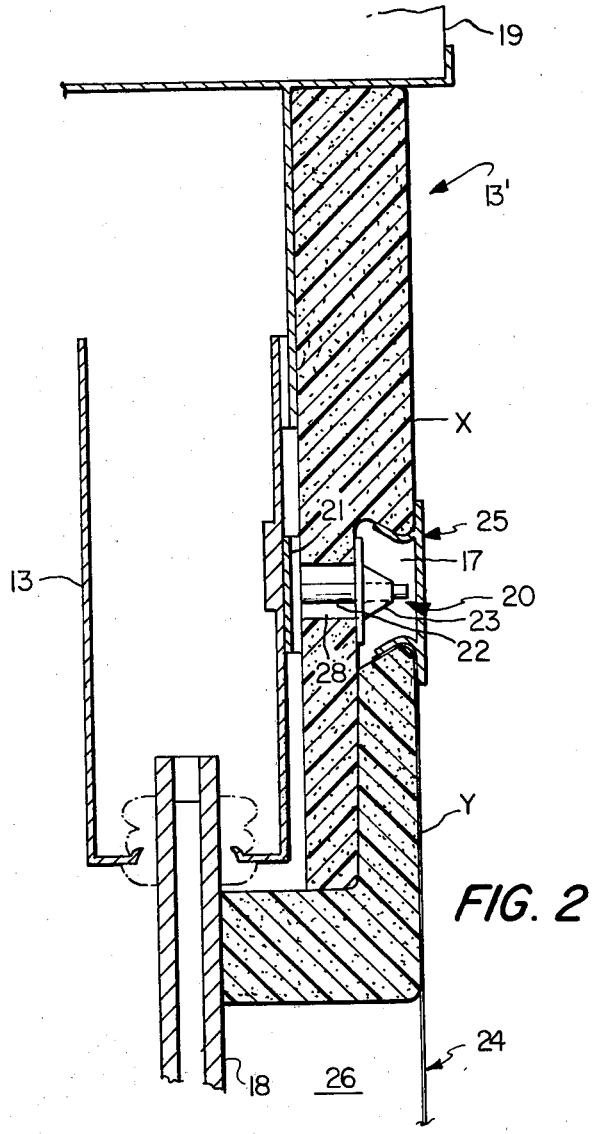
FIG. 2 is a cross-section view of the metal sliding door of FIG. 1 fitted with the polystyrene frame and vinyl sheet of the present invention along the line A of FIG. 1.
Figure 3:
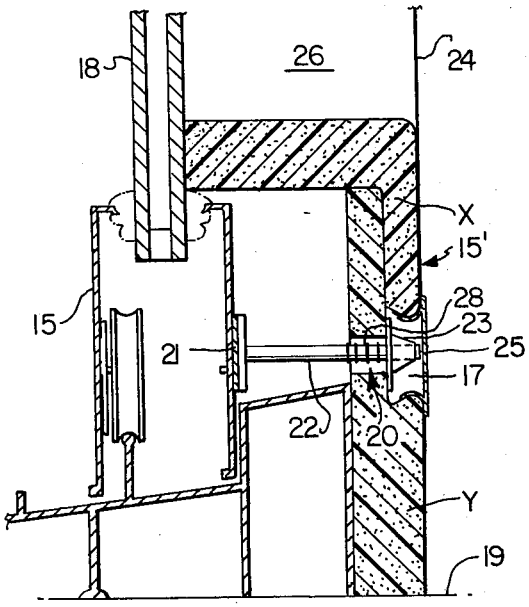
FIG. 3 is a cross-section view of the metal sliding door of FIG. 1 fitted with the polystyrene frame and vinyl sheet of the present invention along the line B of FIG. 1.

The present invention is designed to fit over the interior frame of both windows and doors. Shown in FIG. 1 is the typical sliding glass door which has a metal frame 11. Each of the figures shows a cross-section of the present invention in position at the top, bottom, side and center mullion of such a sliding glass door. In each of the figures, similar numbers are used to designate the similar elements.

Figure 6:
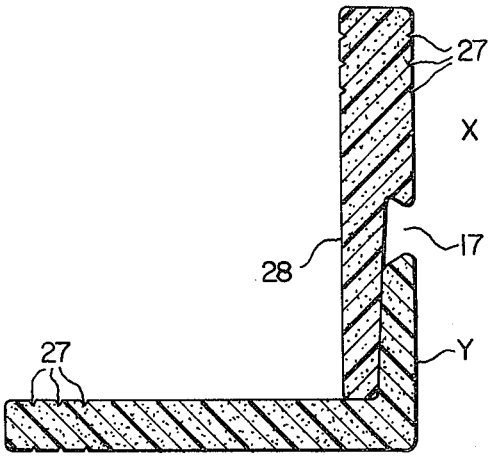
FIG. 6 is a cross-sectional view of the polystyrene frame with break-away sections for adjusting the lengths of the sides of the frame.
Figure 7A:
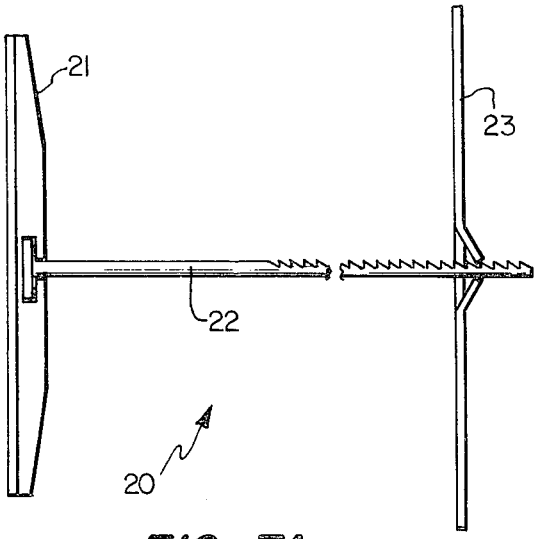
FIGS. 7A – 7D are views of the fastening mechanism assembled (7A) and the various parts thereof individually (7B – 7D).
Figure 7B:
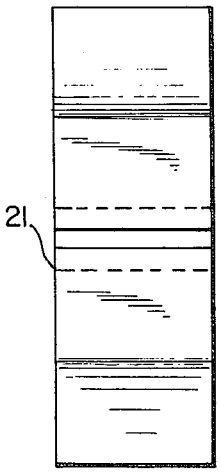
Figure 7D:
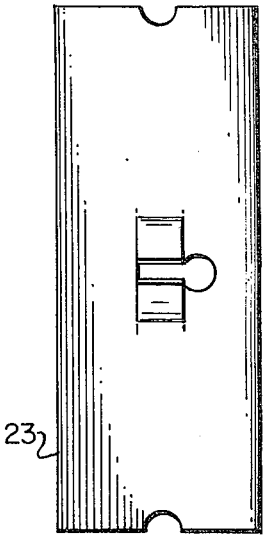
Figure 7C:
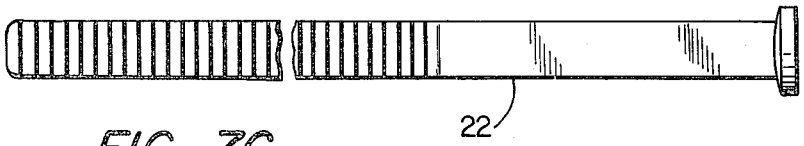

The framework 12 of the present invention is made of expanded polystyrene, or other expanded insulating chemicals, in predetermined lengths to fit the door frame top 13, sides 14,14*a*, bottom 15, and center mullion 16 of the metal frame 11. Each of the lengths is comprised of two separate pieces X,Y of expanded polystyrene glued together to form a dove tail reglet 17 and each length can be cut and fitted to the actual length required for varying door dimensions. In addiiton, as shown in FIG. 6, the separate pieces X,Y of the polystyrene frames 12 can also be provided in universal dimensions with break-away sections 27 to permit adjustment of the frame's 12 dimensions so that its size can be easily altered to fit all of the various manufacturer's sliding glass doors and windows. The top 13', bottom 15', and side, 14', **14*a'* polystyrene frames are designed to cover, completely, the respective portions of the door frame 11 from the glass 18 in the door to the structural material 19 surrounding the door frame. The covering frame 16' over the center mullion 16 is designed to completely cover the mullion from the glass 18 on one side of the glass 18*a*** on the other side of the mullion.

The expanded polystyrene, such as "Dylite" produced by Atlantic Richfield (ARCO), used in this invention has a density of 1.0 to 2.5 lb/cubic foot, the density varying with the specific size of the polystyrene frame member. Each of the break-away sections 27 of the polystyrene frame 12 are approximately ¼ inch wide.

The individual pieces 13' – 16' of the polystyrene frame are held in position over the door frame by mechanical fasteners 20 fastened to the door frame (FIGS. 7A – 7D). The fastener mechanism 20 is designed to fit through a hole 28 in the reglet 17 formed in the polystyrene frame to secure and compress the polystyrene frame to the door frame. Each of the mechanical fasteners 20 has a base strip 21 which is glued to the door frame 11 with a commercially available pressure sensitive adhesive and a fastening extension 22 which is removably fitted to the base strip 21. This fastening extension 22 fits through the hole 28 in the reglet 17 and has a fastener 23 which removably fits onto the fastening extension 22 and presses against and compresses the polystyrene frame in position against the door frame.

By removing the fastener 23, the polystyrene frame can be removed from the door frame and the fastening extension 22. It is then possible to slide the fastening extension 22 from the base strip 21, thereby leaving only the thin base strip 21 on the door frame to be used again when the polystyrene frame 12 is again fitted to the door frame 11. The base strips 21 are thin enough that they do not interfere with the sliding operation of the door.

The base strip 21, and the fastening extension 22, are preferably made from extruded plastic material, and the fastener 23 may be made from a lightweight metal, such as brass or tin. It should, however, be noted that these pieces may be made of any suitable material.

After the polystyrene frame 12 is fitted around the door frame 11, vinyl sheet material 24 is stretched over the frame 12 and held in position by retaining the vinyl material 24 in the reglet 17 by means of an extruded plastic spring strip 25 which fits tightly and removably against the inside edge of the reglet. The vinyl 24 is thus held away from the glass 18 in the door by a distance corresponding to the width of the polystyrene frame above the glass 18, preferably one inch, and creates a sealed dead air space 26, thereinbetween, In this manner, the vinyl material 24 can be tightly held across the polystyrene frame, but still be easily removable by simply removing the plastic spring strip 25 from the reglet 17.

For use on interior windows and doors where good visibility is desired, 4 mil clear cast vinyl sheet material is preferred. However, it is understood that any type of suitable sheet material may be used and still be within the scope of this invention.

Figure 4:
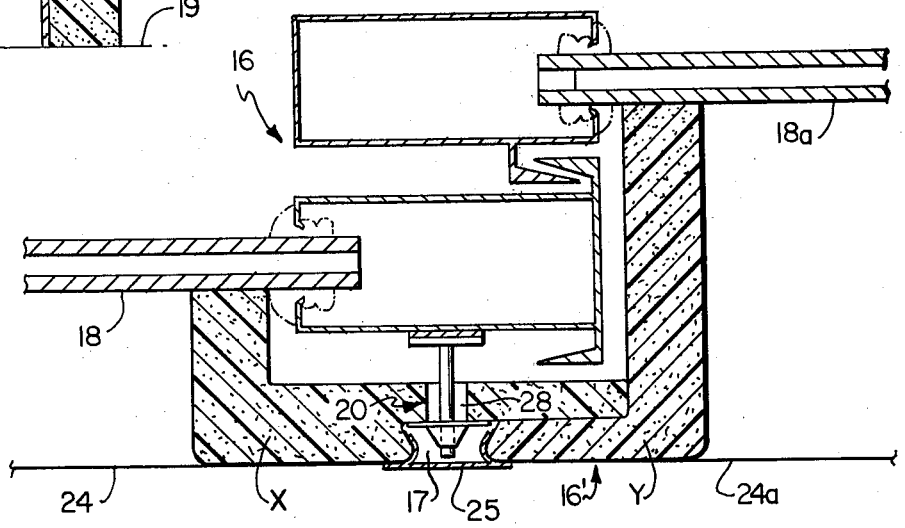
FIG. 4 is a cross-section view of the metal sliding door of FIG. 1 fitted with the polystyrene frame and vinyl sheet of the present invention along the line C of FIG. 1.
Figure 5:
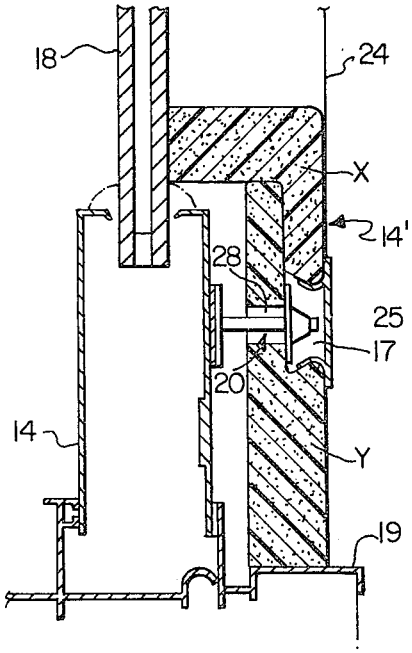
FIG. 5 is a cross-section view of the metal sliding door of FIG. 1 fitted with the polystyrene frame and vinyl sheet of the present invention along the line D of FIG. 1.

As shown in FIG. 4, when the entire polystyrene frame 12 is fitted over a pair of sliding doors, a center mullion frame 16' is formed in the same manner as the polystyrene side frames 13' – 15'; that is, two polystyrene frame pieces X, Y are joined together and a reglet 17 is formed there also. The only difference being that the reglet 17 in the center frame 16' receives two pieces of the vinyl sheet material **24, 24*a* which cover respectively both glass portions 18, 18*a* of the door. Both of the vinyl sheets 24, 24*a* are held in the reglet 17 by a single spring strip 25.**

In position, then, around the door frame 11, the polystyrene frame 12 completely covers the exposed portions of the door frame 11 and covers the exposed glass areas **18, 18*a* with vinyl sheet material 24, 24*a* which is spaced from the glass corresponding to the size of the polystyrene frame with a dead air space thereinbetween. The frame 12 is removably secured to the door frame 11 by likewise removable mechanical fasteners 20, and the vinyl sheets 24, 24*a* are removably retained in the reglets 17 formed in the polystyrene frame by the plastic spring strip 25.**

What is claimed is:

1. An apparatus for fitting over the inside frames and glass of doors and windows built into structures to prevent heat loss therethrough, said apparatus comprising:

removable framing means for completely covering all exposed portions of said inside frames from the glass surface to the structural material into which the frames are built, said framing means having a channel groove around the entire perimeter thereof;

fastening means attached to said inside frame and fitted through the channel groove in said framing means for removably fastening said framing means to said inside frame;

covering means stretched across said framing means and inserted into said channel groove for covering the area above the glass surface within the boundaries of said framing means; and retaining means removably biased into said channel groove for retaining said covering means therein and covering said fastening means, whereby inserting said retaining means into said channel groove after the covering means has been stretched across the frame and inserted into the groove will hold the covering means tautly across the frame.

2. An apparatus as claimed in claim 1, wherein said framing means is comprised of:

a plurality of framing of framing segments for covering the top, bottom, side and any center framing portions of said inside frames, each framing segment covering one portion of the inside frame and comprised of two framing pieces joined together to fit over the inside frame portion from the glass to the surrounding structural material, said pieces forming said channel groove where they are joined together.

3. An apparatus as claimed in claim 2, wherein at least one of said framing pieces at the end opposite the end joined to another framing piece to form said channel groove has break-away means formed thereon for varying the length of said framing piece.

4. An apparatus as claimed in claim 2, wherein said framing pieces are comprised of expanded insulating chemicals.

5. An apparatus as claimed in claim 2, wherein said framing pieces are comprised of expanded polystyrene.

6. An apparatus as claimed in claim 1, wherein said fastening means is comprised of:

a base strip adhesively attached to the inside frame;

a fastening extension removably fitted to the base strip and extending outward therefrom for fitting through the channel groove in the framing means; and a fastener removably fitted onto the fastening extension for holding the framing means in position around the fastening extension and over the inside frame.

7. An apparatus as claimed in claim 1, wherein said covering means is comprised of:

4 mil clear cast vinyl sheet material.

8. An apparatus as claimed in claim 1, wherein said retaining means is comprised of:

an extruded plastic strip removably fitted into and forced against the inside walls of the channel groove.

* * * * *